US005815588A

United States Patent [19]

Traini, Jr.

[11] Patent Number: 5,815,588

[45] Date of Patent: Sep. 29, 1998

[54] VIDEO CAMCORDER SPEAKER ASSEMBLY

[76] Inventor: Vespucci B. Traini, Jr., 133 Aluminum City Ter., New Kensington, Pa. 15068

[21] Appl. No.: 695,124

[22] Filed: Aug. 5, 1996

Related U.S. Application Data

[63] Continuation-in-part of Ser. No. 393,984, Feb. 24, 1995, abandoned, which is a continuation-in-part of Ser. No. 96,760, Jul. 26, 1993, abandoned, which is a continuation-in-part of Ser. No. 661,066, Feb. 26, 1991, Pat. No. 5,361,378.

[51] Int. Cl.[6] ..... H04R 5/02

[52] U.S. Cl. ..... 381/309; 381/374; 381/338

[58] Field of Search ..... 381/25, 74, 154, 381/183

[56] References Cited

U.S. PATENT DOCUMENTS

| | | | |
|---|---|---|---|
| 1,568,721 | 1/1926 | Butcher et al. . | |
| 4,110,583 | 8/1978 | Lepper | 381/25 |
| 4,173,715 | 11/1979 | Gosman | 381/183 |
| 4,550,343 | 10/1985 | Nakatani . | |
| 4,742,887 | 5/1988 | Yamagishi | 381/154 |
| 4,862,278 | 8/1989 | Dann et al. . | |
| 5,007,091 | 4/1991 | Alasaarela et al. . | |
| 5,022,486 | 6/1991 | Miura et al. | 381/154 |
| 5,134,660 | 7/1992 | Larose . | |

*Primary Examiner*—Forester W. Isen

*Attorney, Agent, or Firm*—Webb Ziesenheim Bruening Logsdon Orkin & Hanson, P.C.

[57] ABSTRACT

A speaker assembly for connecting an audio source to a microphone of a video recorder includes a housing having an exterior and a substantially hollow interior. An earphone assembly is provided having at least one speaker, with the at least one speaker located in the interior of the housing. Further, a video recording device is provided having a built-in audio source.

18 Claims, 6 Drawing Sheets

VIDEO CAMCORDER SPEAKER ASSEMBLY

CROSS REFERENCE TO RELATED APPLICATION

This application is a continuation-in-part of U.S. patent application Ser. No. 08/393,984, filed Feb. 24, 1995, which is a continuation-in-part of U.S. patent application Ser. No. 08/096,760, filed Jul. 26, 1993, both now abandoned, which is a continuation-in-part of U.S. patent application Ser. No. 07/661,066, filed Feb. 26, 1991, now U.S. Pat. No. 5,361, 378, granted Nov. 1, 1994.

BACKGROUND OF THE INVENTION

1. Field of the Invention

This invention relates generally to video recorders and, more particularly, to a speaker assembly attachable to the microphone of a video recorder to supply an audio input to the video recorder microphone. The invention also relates to a video recorder having a built-in audio source.

2. Description of the Prior Art

The use of video recorders or "camcorders" has increased dramatically over recent years. Particularly popular are hand held video recorders having built-in microphones which allow for the simultaneous recording of ambient sound and video images onto a video tape, which can be played back at a later date. The video taping of sporting events and social gatherings, such as weddings, is quite popular throughout the United States.

However, when using a video recorder, there are occasions when it is desirable to enhance the sound track of the video tape with an overlay of background music. Such occasions include the video taping of sunsets, landscape scenes or other outdoor events in which a background audio track would help "set the mood" of the scene. Other examples of such occasions include weddings, in which there are long periods of virtual silence, or social gatherings, such as a party, in which the ambient sound includes a jumble of conversations caused by a number of people all talking at the same time. In the distant past, the addition of such background music would have to be done by complex dubbing procedures after the video tape was recorded.

However, various devices have recently been developed to supply an audio signal from an audio source, such as a tape player or compact disc player, to the external microphone of a video recorder. Thus, an overlay of background music may be recorded directly onto the sound track of the video tape as the video recorder is operating. U.S. Pat. No. 5,134,660 to Larose discloses such a device. The Larose device is a wiring harness having a miniature speaker attached to a clip. The clip is configured to grasp the external microphone of the video recorder to hold the speaker in direct contact with the external microphone of the video recorder. Another example of such a device is shown in my previous U.S. Pat. No. 5,361,378. My previous patent discloses a pair of speakers which are spring biased to be secured on the external microphone of a video recorder.

A recent trend in the manufacture of video recorders is to replace the bulky external microphone of the video recorder with an internal microphone to streamline the look of the video recorder. In these new video recorders, the microphone structure of the video recorder microphone is located inside the body of the video recorder. A mesh screen covers an opening in the camera body leading to the internal microphone. This mesh screen is substantially level with the exterior surface of the video recorder to present a smooth external surface. While the previously described speaker devices are adequate for use with bulky external microphones, they are not easily adaptable for use with video recorders having internal microphones since there is no easy way for the prior speaker devices to clamp onto the exterior surface of the video recorder.

Therefore, it is an object of the present invention to provide a compact speaker assembly which can be used with a video recorder having either an external or an internal microphone to supply an audio signal to the video recorder microphone. It is a further object of the invention to provide a modified video recorder having an audio source built directly into the video recorder.

SUMMARY OF THE INVENTION

A speaker assembly for connecting an audio source to a microphone of a video recorder includes a housing having an exterior and a substantially hollow interior. An earphone assembly is provided having at least one speaker, with the at least one speaker located in the interior of the housing. A bore extends through the housing.

A video recording device according to the invention has a built-in audio source. The video recording device includes a video recorder having a record button. A video camera is in electronic communication with the record button and a video recording head. A microphone is in electronic communication with the record button and an audio recording head. An audio activation switch is in electronic communication with the record button and the audio source.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
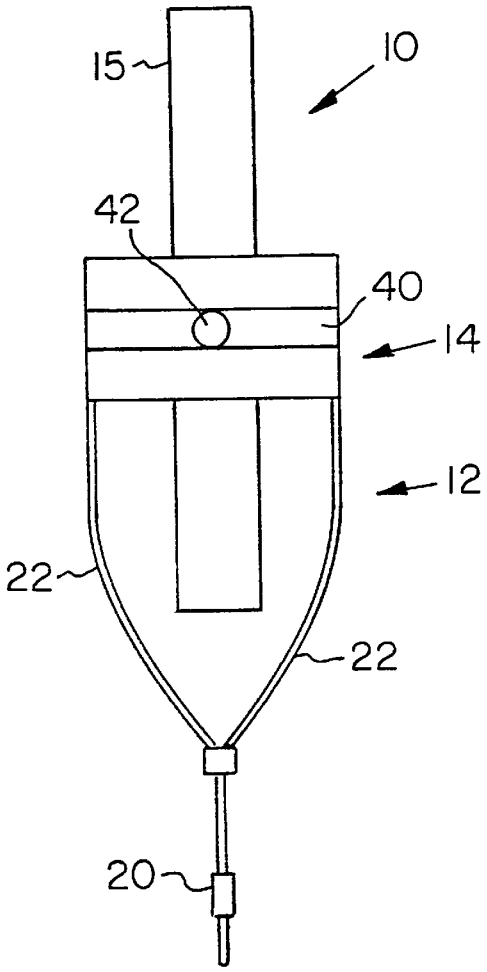
FIG. 1 is a bottom view of a speaker assembly according to the present invention.

For purposes of the description hereinafter, the terms "upper", "lower", "right", "left", "rear", "front", "side", "end", "bottom", "vertical", "horizontal" and derivatives thereof shall relate to the invention as it is oriented in the drawing figures. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state to the contrary.

Figure 2:
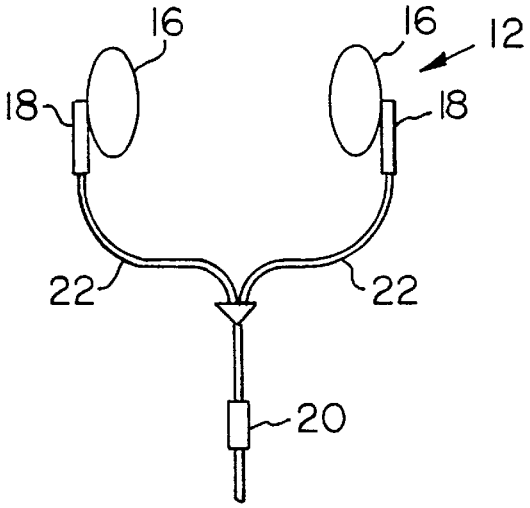
FIG. 2 is a plan view of an earphone assembly.

A speaker assembly according to the present invention is designated 10 throughout the drawings. As shown in FIG. 1 of the drawings, the speaker assembly 10 includes an earphone assembly 12, a speaker housing 14 and a flexible attachment strap 15. As shown in FIG. 2 of the drawings, the earphone assembly 12 includes a pair of substantially circular speakers 16, each of which is typically surrounded by a foam jacket. The speakers 16 have a substantially rectangular post 18 and are connected to a jack 20 by wires 22. Such earphone assemblies 12 are well known in the art and are commercially available from a variety of sources.

The attachment strap 15 is substantially rectangular and is preferably made of VELCRO® material. The attachment strap 15 has a preferred length of about 6 to 8 inches and a preferred width of about ⅝ inch.

Figure 3:
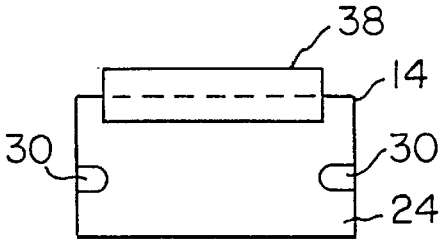
FIG. 3 is a side view of a speaker housing.
Figure 5:
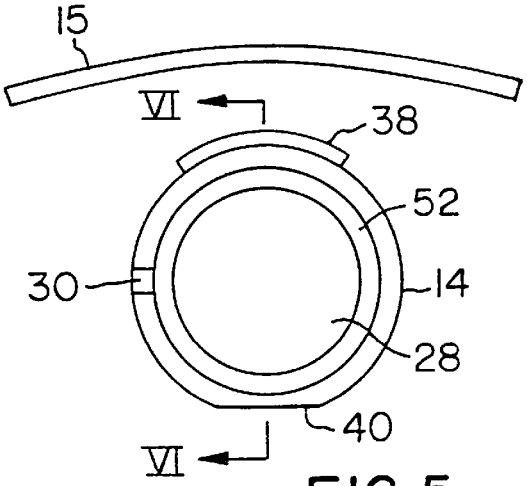
FIG. 5 is an end view of the housing shown in FIG. 3 with an attachment strap.

A first embodiment of the housing 14 is shown in FIGS. 3–6 of the drawings. As shown in FIGS. 3 and 5 of the drawings, the housing 14 is preferably a hollow cylinder having an exterior and a substantially hollow interior. The housing 14 includes a sidewall, opposed open ends, an outer surface 24 and an inner surface 26, with a longitudinal passage 28 extending through the housing 14. A shown in FIG. 3 of the drawings, the rear of the housing 14 includes a pair of longitudinally extending notches 30 located adjacent each end of the housing. A backing member 38, such as a piece of VELCRO®, is attached to the upper side of the housing 14.

Figure 4:
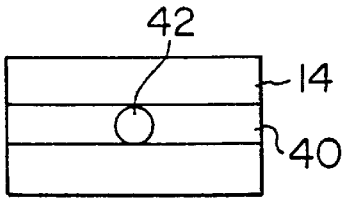
FIG. 4 is a bottom view of the housing shown in FIG. 3.

As shown in FIGS. 4 and 5 of the drawings, the bottom of the housing 14 has a substantially flat portion 40 extending substantially longitudinally along the length of the housing 14. A bore 42 is located in the housing 14 along the flat portion 40 and extends through the sidewall of the housing 14. The bore 42 is preferably located midway between the ends of the housing 14.

Figure 6:
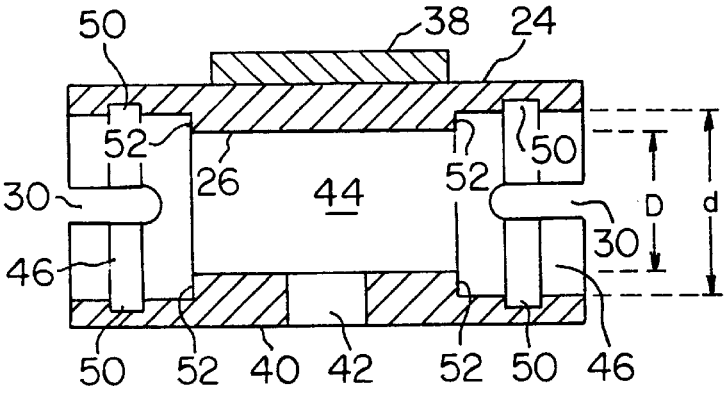
FIG. 6 is a section on line VI—VI of FIG. 5.

As shown in FIG. 6 of the drawings, the inner surface 26 of the housing 14 is preferably not smooth throughout the length of the housing 14 but rather includes an inner region 44 located substantially in the middle of the housing 14 and two outer regions 46 located adjacent the ends of the housing. The diameter "d" of the outer regions 46 is larger than the diameter "D" of the inner region 44. Each outer region 46 includes an outer annular groove 50 with an annular step region 52 formed in the transition zone between the inner region 44 and the outer region 46. The housing 14 is preferably made of a wear resistant material, such as PVC, and has a preferred length of about 1¼ to 1½ inches with an outer diameter of about ⅞ inch. The diameter "d" of the outer regions 46 is preferably about 11/16 inch and the diameter "D" of the inner region 44 is preferably about 9/16 inch.

Figure 7:
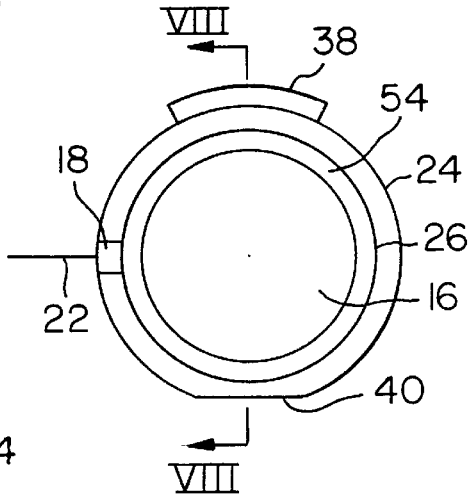
FIG. 7 is an end view of the housing shown in FIG. 5 with a speaker inserted into the housing.
Figure 8:
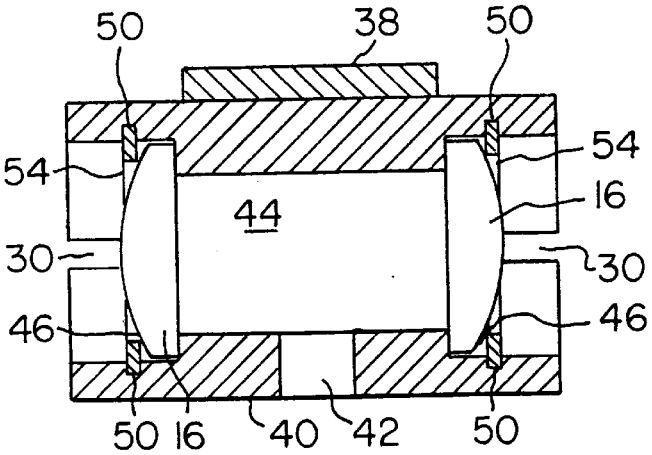
FIG. 8 is a section on line VIII—VIII of FIG. 7.

FIGS. 7 and 8 of the drawings show the assembled speaker assembly 10 with a speaker 16 located in each outer region 46 of the housing 14. The front of the speaker 16 in each outer region 46 abuts the step region 52, with the two speakers 16 facing each other. A removable outer locking member 54, such as an elastically expandable or bendable plastic annular locking ring, is located in each annular groove 50 and abuts the rear surface of the adjacent speaker 16 to hold the speaker 16 in place in the outer region 46. The post 18 of each speaker 16 extends through one of the notches 30 in the housing 14 to prevent the speaker 16 from rotating in the outer region 46. Alternatively, the groove 50 and locking member 54 may be deleted and each speaker 16 may be attached to the housing 14 by an adhesive, such as a silicone bonding glue. As shown in FIG. 5 of the drawings, the attachment strap 15 is removably attached to the backing member 38.

Figure 9:
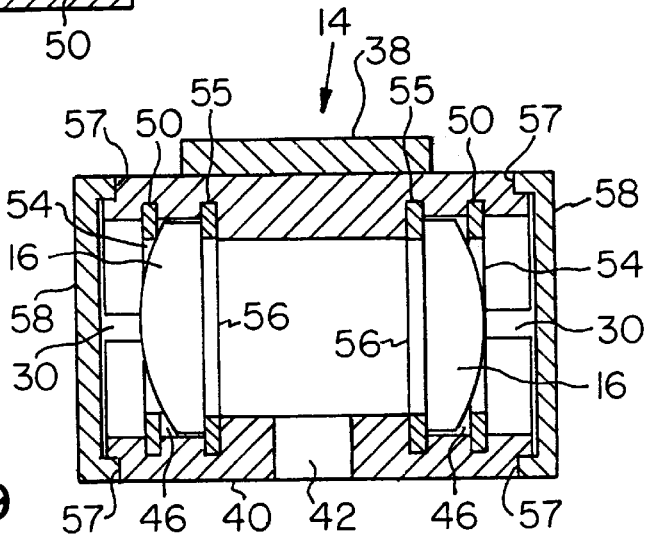
FIG. 9 is a sectional view of an alternative embodiment of the speaker assembly shown in FIG. 8.

FIG. 9 of the drawings shows an alternative embodiment of the housing 14 shown in FIG. 8 of the drawings. In the embodiment shown in FIG. 9 of the drawings, each outer region 46 includes an outer annular groove 50 with an outer locking member 54 as shown in FIG. 8 of the drawings. However, in the embodiment shown in FIG. 9 of the drawings, each outer region 46 further includes an inner annular groove 55 having an inner locking member 56. In each outer region 46, a speaker 16 is held between the outer locking member 54 and the inner locking member 56. In order to provide a conduit for the sound from speaker 16 to the bore 42, the inner locking members 56 are not solid but rather are formed in the shape of an annular ring having a central opening. In addition, each end of the housing 14 includes an exterior annular beveled region 57 with a cap 58 attached at each end of the housing 14. The caps 58 may be attached in any conventional manner, such as gluing or threads, or may be made of a flexible material, such as rubber, such that they grasp the outer ends of the housing 14.

Figure 10:
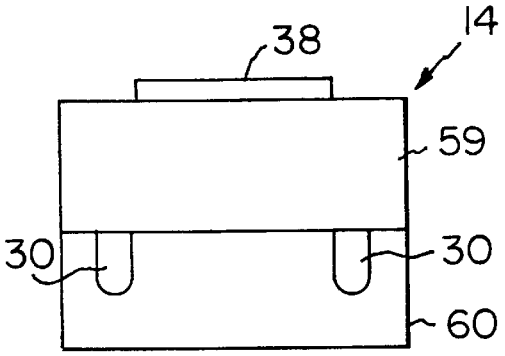
FIG. 10 is a side view of an alternative speaker housing.
Figure 12:
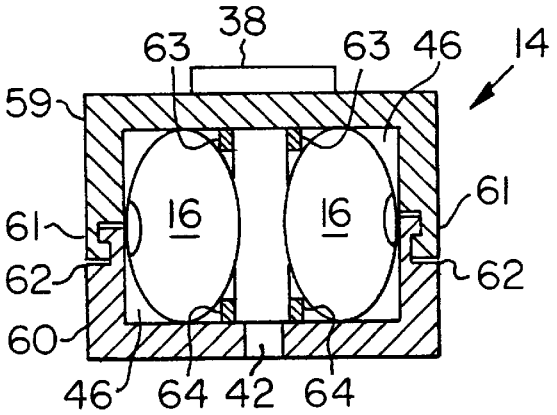
FIG. 12 is a section on line XII—XII of FIG. 11.
Figure 11:
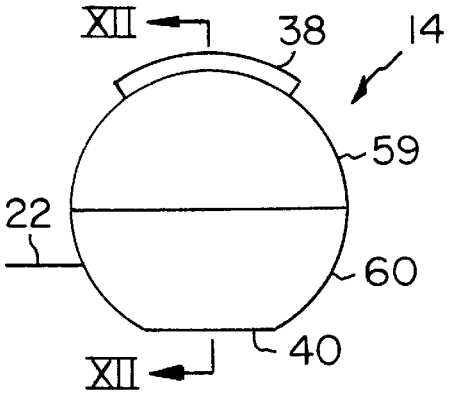
FIG. 11 is an end view of the alternative housing shown in FIG. 10.

An alternative embodiment of the housing 14 is shown in FIGS. 10–12 of the drawings. In this alternative embodiment, the housing 14 includes an upper section 59 and a lower section 60 having flexible end walls. As shown in FIG. 12 of the drawings, each end of the upper section 59 is flexible and includes an inwardly facing hook portion 61 and each end of the lower section 60 is flexible and includes an outwardly facing hook portion 62. The upper section 59 includes a pair of spaced apart upper positioning elements 63 depending from the top interior surface of the upper section 59. The lower section 60 also includes a pair of spaced apart lower positioning elements 64 extending from the interior lower surface of the lower section 60. The speakers 16 are positioned in the housing 14 such that the rear surface of each speaker 16 is adjacent to one of the interior ends of the housing 14 and the front of the speaker 16 is adjacent to one of the upper positioning elements 63 and to one of the lower positioning elements 64. As shown in FIG. 10 of the drawings, the lower section 60 includes a pair of notches 30 which extend substantially perpendicularly to the longitudinal axis of the housing 14.

Assembly and operation of the speaker assembly 10 will now be described.

Looking first at the speaker assembly 10 with the housing 14 shown in FIGS. 3–8 of the drawings, the speakers 16 of the earphone assembly 12 are placed in the outer regions 46 of the housing 14 such that the posts 18 of the speakers 16 engage the notches 30 and the front of each speaker 16 abuts one of the step regions 52. A locking member 54 is then inserted into each outer region 46 until the locking member 54 engages the annular groove 50 to hold the speaker 16 in the housing. If the earphone assembly 12 malfunctions, the locking members 54 may be easily removed to allow the replacement of the earphone assembly 12 with a new earphone assembly.

Looking at the speaker assembly 10 with the housing 14 shown in FIG. 9 of the drawings, the inner locking members 56 are inserted into the housing 14 until the inner locking members 56 engage the inner annular grooves 55. The speaker 16 of the earphone assembly 12 are then placed in the outer regions 46 of the housing 14 with the posts 18 of the speakers 16 engaging the notches 30 and with the front of each speaker 16 abutting one of the inner locking members 56. The outer locking members 54 are then inserted into the housing 14 until the outer locking members 54 engage the outer annular grooves 50. Thus, each speaker 16 is held in place between an inner locking member 56 and an outer locking member 54. A cap 58 can then be attached at each of the housing 14 by conventional methods.

Looking next at the housing 14 shown in FIGS. 10–12 of the drawings, the upper section 59 and lower section 60 of the housing 14 are separated. This can be done by placing pressure on the ends of the lower section 60 to bend the hook portion 62 of the lower section 60 out of engagement with the hook portion 61 of the upper section 59. The speakers 16 are then placed in the lower section 60 with the rear of each speaker 16 abutting the interior end wall of the lower section 60 and the lower front of each speaker 16 adjacent one of the lower positioning elements 64. The posts 18 of the speakers 16 engage the notches 30 in the lower section 60. To place the upper section 59 into position, pressure is applied to the ends of the lower section 60 such that the hook portion 62 on the lower section 60 are bent slightly inwardly. The upper section 59 is then aligned with and placed on top of the lower section 60. When the pressure is released from the ends of the lower section 60, the hook portion 62 on the lower section 60 engage the hook portion 61 on the upper section 59 to hold the upper section 59 and lower section 60 together.

Figure 13:
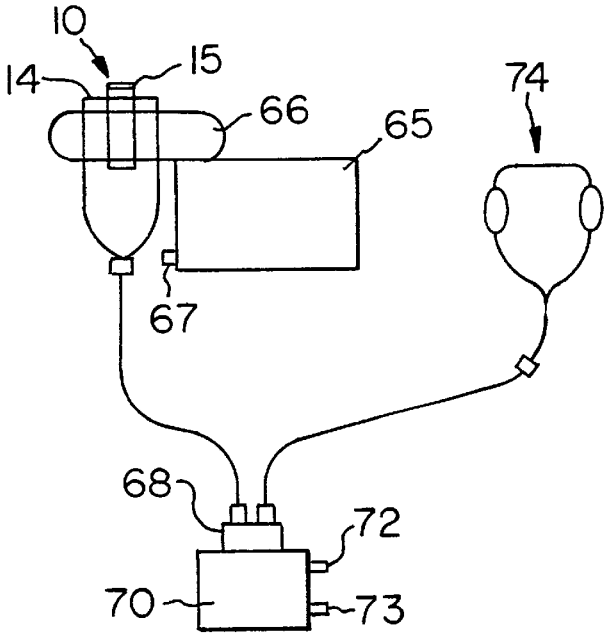
FIG. 13 is a schematic view of the speaker assembly attached to a video recorder having an external microphone.

Use of the speaker assembly 10 with a video recorder 65 having an external microphone 66 and a record button 67 is shown in FIG. 13 of the drawings. The speaker assembly 10 is placed on the outside of the external microphone 66 with the flat portion 40 of the speaker housing 14 abutting the outer surface of the external microphone 66. The attachment strap 15 is then looped around the external microphone 66 and housing 14 such that the VELCRO® backing member 38 and the ends of the VELCRO® attachment strap 15 overlap, thus holding the flat portion 40 having the bore 42 tightly against the outer surface of the external microphone 66.

The jack 20 of the speaker assembly 10 is plugged into a Y-adapter 68 which is, in turn, plugged into an audio source 70, such as a radio, compact disc player or tape player, having a play button 72 and a stop button 73. A set of headphones 74 is also plugged into the Y-adapter 68. The headphones 74 are worn by an operator so that the operator can hear the music being played by the audio source 70.

To record an audio signal, such as background music, onto a video tape, the operator indexes the audio selection in the audio source 70 to the beginning of the selection desired to be recorded. The operator then presses the record button 67 on the video recorder 65 to begin video recording and simultaneously presses the play button 72 on the audio source 70 to start playing the audio selection in the audio source 70. The audio signal from the audio source 70 is transmitted to the speakers 16 in the speaker assembly 10 attached to the external microphone 66. The bore 42 in the flat portion 40 of the housing 14 permits the clear reception of the audio signal by the external microphone 66, which is simultaneously recorded with the video image onto the video tape. When the operator wishes to cease recording the audio signal from the audio source 70, the record button 67 on the video recorder is released and the stop button 73 on the audio source 70 is depressed. In order to reinitiate the recording of the video tape with an audio signal from the audio source 70, the record button 67 and play button 72 are depressed as described above. Thus, a video tape can be made having video images from diverse locations but with a seemingly uninterrupted piece of music.

Figure 14:
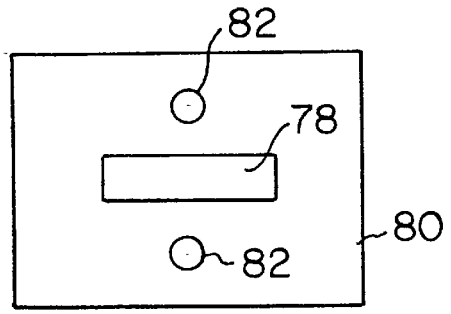
FIG. 14 is a schematic view of the exterior of a video recorder having an internal microphone.
Figure 15:
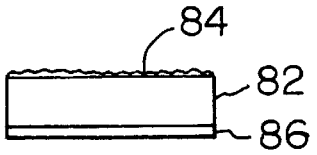
FIG. 15 is a side view of an attachment element.
Figure 16:
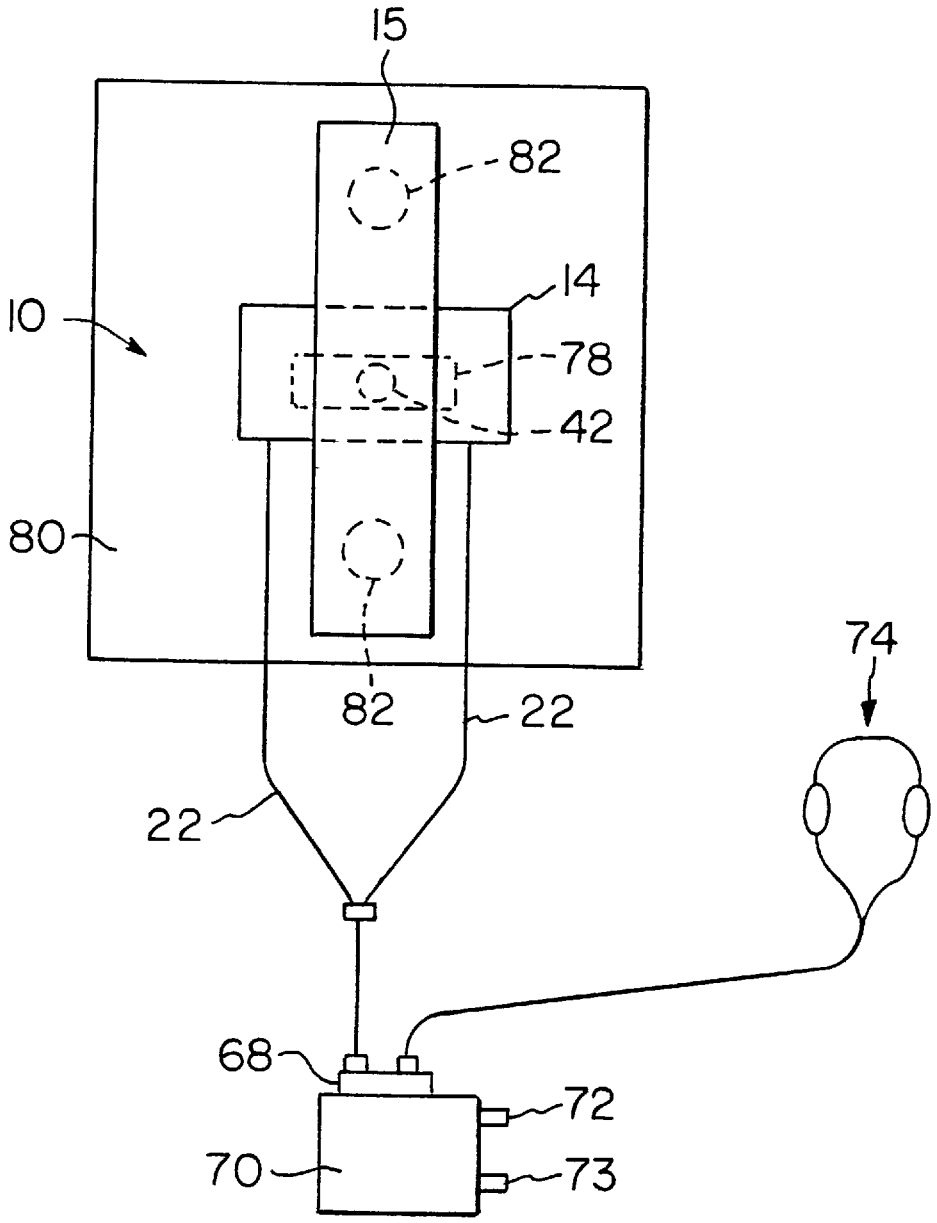
FIG. 16 is a schematic view of the speaker assembly attached to the video recorder shown in FIG. 14.

Use of the speaker assembly 10 with a video recorder 65 having an internal microphone is shown in FIGS. 14–16 of the drawings. As shown in FIG. 14 of the drawings, a screen 78 covers the opening over the internal microphone. The screen 78 is substantially level with the external surface 80 of the video recorder 65. In the preferred method of attaching the speaker assembly 10 to the video recorder 65, a pair of attachment elements 82 are attached to the external surface 80 of the video recorder 65 on each side of the screen 78. As shown in FIG. 15 of the drawings, each attachment element 82 has a VELCRO® surface 84 with an adhesive backing 86. The adhesive backing 86 is used to connect the attachment elements 82 to the video recorder 65. The speaker assembly 10 is positioned approximately midway along the attachment strap 15, with the VELCRO® backing member 38 contacting the VELCRO® surface of the attachment strap 15. The speaker assembly 10 is placed against the screen 78 with the bore 42 of the housing 14 abutting the screen 78. Each end of the attachment strap 15 is then placed in contact with the VELCRO® surface of one of the attachment elements 82 to hold the housing 14 tightly against the screen 78. The starting and stopping of video and audio recording is the same as discussed above with respect to the video recorder having an external microphone.

To remove the speaker attachment 10 from the video recorder 65, the ends of the attachment strap 15 are pulled away from the attachment elements 82 and the speaker assembly 10 is removed from the video recorder 65. The attachment elements 82 are preferably left in place.

Figure 17:
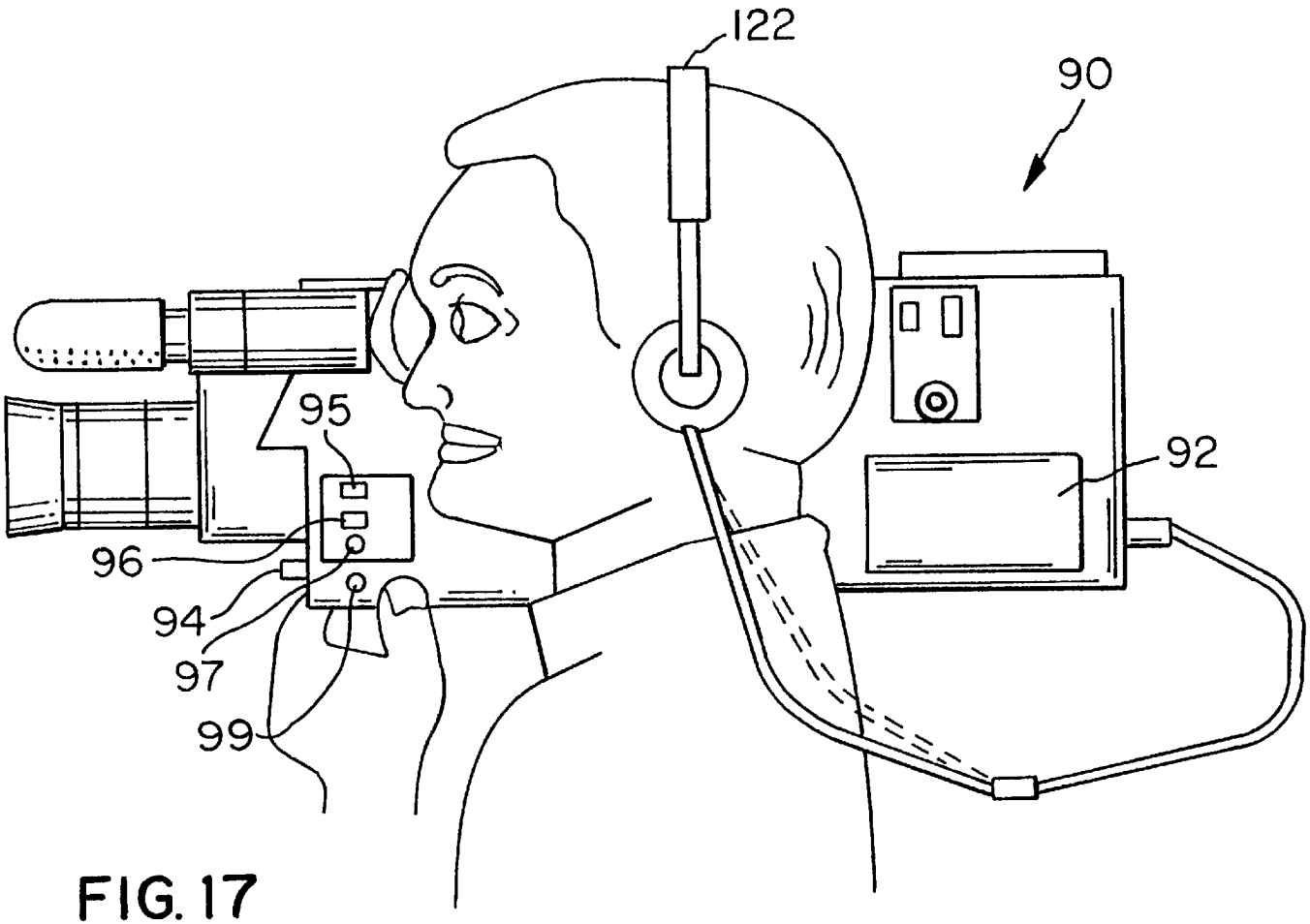
FIG. 17 is a side view of a modified video recorder.
Figure 18:
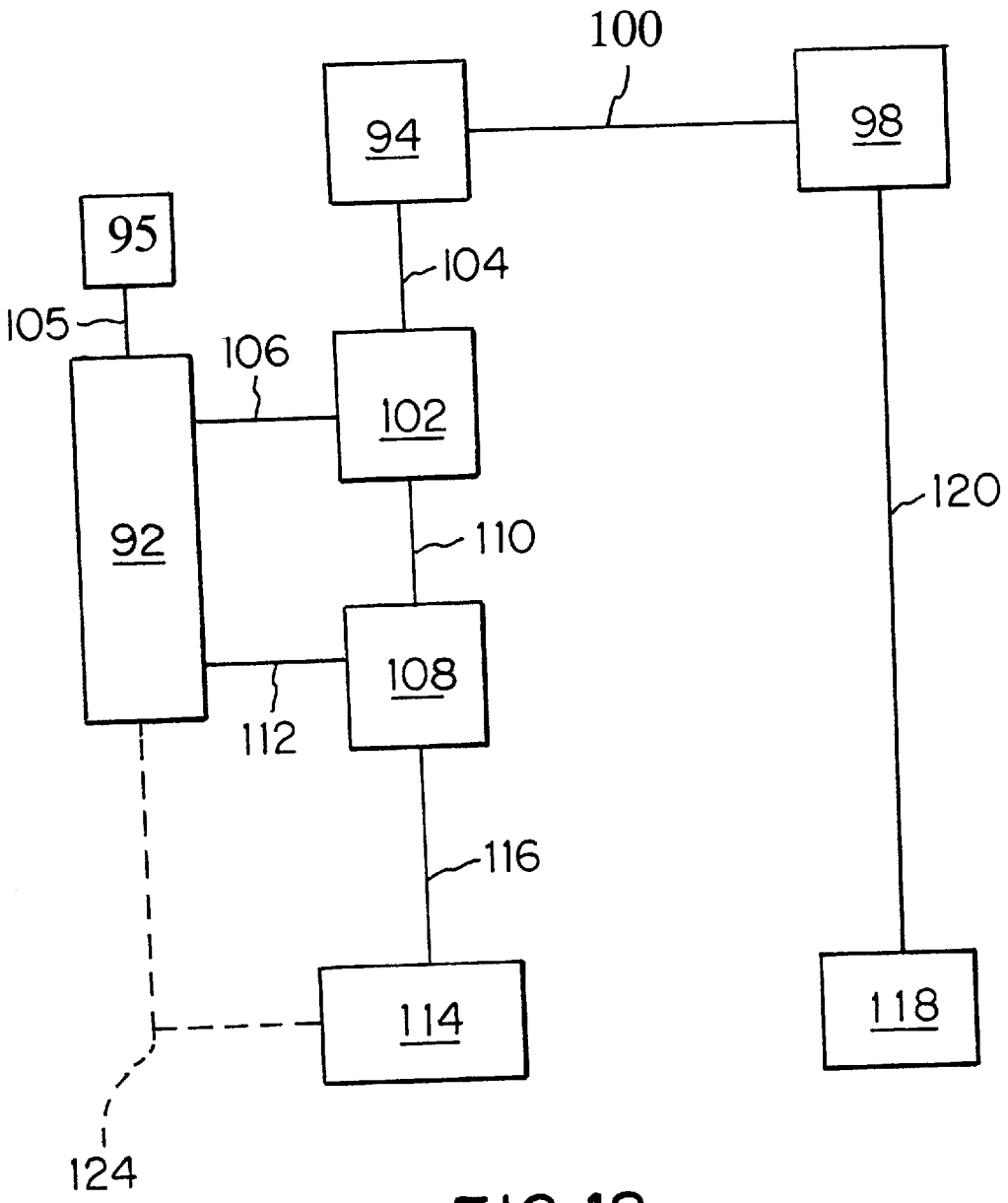
FIG. 18 is a schematic wiring diagram for the modified video recorder shown in FIG. 17.

A modified video recorder 90 having at least one built-in audio source 92 is shown in FIG. 17 of the drawings. The audio source 92 preferably includes its own power supply, such as batteries. Alternatively, the audio source 92 may be connected to the power source of the video recorder 90. The modified video recorder 90 includes a record button 94, an audio source power button 95, an audio activator button 96, a volume control knob 97 and a video recorder power button 99. These buttons 94, 95 and 96 and knob 97 may be placed at any convenient location on the video recorder 90. A preferred schematic wiring diagram for the modified video recorder 90 is shown in FIG. 18 of the drawings. As shown in FIG. 18 of the drawings, the video recorder record button 94 is electrically connected to the video camera 98 of the video recorder 90 by a wire 100 and is also connected to an audio activation switch 102 by a wire 104. The audio source power button 95 is connected to the audio source 92 by a wire 105. The audio activation switch 102 is connected to the audio source 92 by a wire 106 and is also connected to the recorder microphone 108 by a wire 110. The recorder microphone 108 is connected to the audio source 92 by a wire 112 and is also connected to a digitally synchronized audio recording head 114 by a wire 116. The video camera 98 is connected to a digitally synchronized video recording head 118 by a wire 120. As shown in FIG. 17 of the drawings, a set of headphones 122 may be wired in parallel to the audio output of the audio source 92 to allow the operator to monitor the audio signal being introduced into the microphone 108.

In an alternative embodiment of the modified video recorder 90, the wire 112 from the audio source 92 to the microphone 108 is deleted and the audio source 92 is connected directly to the audio recording head 114 by a wire 124.

Operation of the modified video recorder 90 is as follows. In the normal operating mode, the audio activation switch 102 is in the off position. In this normal operating mode, when the video recorder power button 99 is in the "on" position and the record button 94 is depressed, the video camera 98 is activated and begins transmitting video signals to the video recording head 118. The microphone 108 is simultaneously activated and begins transmitting the ambient sound detected by the microphone 108 to the audio recording head 114. Since the activation switch 102 is off, no signal flows through wire 106 to activate the audio source 92.

When the operator wishes to place an audio track onto the video tape, the audio source power button 95 is depressed and the activation switch 102 is placed in the "on" position. In this configuration, when the record button 94 is depressed, the video camera 90 and both the microphone 108 and the audio source 92 are activated. In the preferred embodiment, the audio signal from the audio source 92 flows through the wire 112 and into the microphone 108. The combined audio signal from the microphone 108 and the audio source 92 is then fed through the wire 116 into the audio recording head 114 and is placed onto the video tape being recorded.

In the alternative embodiment, the wire 112 is deleted and the audio signal from the microphone 108 is transmitted directly to the audio recording head 114 through wire 116 and the audio signal from the audio source 92 is transmitted directly to the audio recording head 114 through wire 124.

It will be readily appreciated by those skilled in the art that modifications may be made to the above-described invention without departing from the concepts disclosed in the foregoing description. Such modifications are to be considered as included within the following claims, unless the claims by their language expressly state otherwise. Accordingly, the particular embodiments described in detail herein are illustrative only and are not limiting as to the scope of the invention which is to be given the full breadth of the appended claims and any and all equivalents thereof.

I claim:

1. A speaker assembly for connecting an audio source to a microphone of a video recorder, comprising:

a housing having an exterior and a substantially hollow interior;

an earphone assembly having at least one speaker, with said at least one speaker located in the interior of said housing;

a bore extending through said housing; and an attachment device for holding the sneaker assembly against the video recorder microphone.

2. The speaker assembly as claimed in claim 1, wherein said housing includes a flat portion extending substantially longitudinally along said exterior of said housing, with said bore located along said flat portion.

3. The speaker assembly as claimed in claim 1, wherein said housing includes at least one notch and said at least one speaker includes a post, with said post of said at least one speaker engaging said at least one notch.

4. The speaker assembly as claimed in claim 1, including a backing member attached to said exterior of said housing, wherein said attachment device is configured to detachably engage said backing member.

5. The speaker assembly as claimed in claim 1, wherein said interior includes at least one outer region having a step region and an outer annular groove, with an outer locking member removably located in said outer annular groove and wherein said at least one speaker is located in said at least one outer region between said step region and said outer locking member.

6. The speaker assembly as claimed in claim 1, wherein said interior includes at least one outer region having an outer annular groove with an outer locking member located in said outer annular groove and an inner annular groove with an inner locking member located in said inner annular grove, wherein said at least one speaker is located between said inner locking member and said outer locking member.

7. A speaker assembly for connecting an audio source to a microphone of a video recorder, comprising:

a housing having an exterior and a substantially hollow interior;

an earphone assembly having at least one speaker, with said at least one speaker located in the interior of said housing;

a bore extending through said housing;

an upper section having a flexible end wall and a lower section having a closed end wall, wherein said upper section and said lower section are configured to be reversibly latchable; and at least one upper positioning element located on said upper section and at least one lower positioning element located on said lower section, wherein said at least one speaker is located between said upper positioning element, said lower positioning element and said end walls of said upper and lower sections.

8. A speaker assembly for connecting an audio source to a microphone of a video recorder, comprising:

a hollow housing having an exterior, an interior, a longitudinal axis and a pair of outer regions;

an earphone assembly having a pair of speakers, with one of said speakers located in each outer region of said hollow housing;

a bore extending through said housing substantially perpendicularly to said longitudinal axis; and an attachment device for holding the speaker assembly against the video recorder microphone.

9. The speaker assembly as claimed in claim 8, wherein said housing includes a flat portion extending substantially longitudinally along said exterior of said housing, said flat portion configured to abut the video recorder microphone.

10. The speaker assembly as claimed in claim 8, wherein said hollow housing includes an inner region located between said two outer regions, with a diameter of said inner region being less than a diameter of said outer regions.

11. The speaker assembly as claimed in claim 8, further including a backing member attached to said exterior of said housing, wherein the attachment device includes an attachment strap configured to detachably engage said backing member.

12. A speaker assembly for connecting an audio source to a microphone of a video recorder, comprising:

a hollow housing having an exterior, an interior, a longitudinal axis and a pair of outer regions;

an earphone assembly having a pair of speakers, with one of said speakers located in each outer region of said hollow housing; and a bore extending through said housing substantially perpendicularly to said longitudinal axis, wherein each said outer region includes an inner locking member and an outer locking member, with each said speaker located in one of said outer regions between said inner locking member and said outer locking member.

13. A speaker assembly for connecting an audio source to a microphone of a video recorder, comprising:

a hollow housing having an exterior, an interior, a longitudinal axis and a pair of outer regions;

an earphone assembly having a pair of speakers, with one of said speakers located in each outer region of said hollow housing; and a bore extending through said housing substantially perpendicularly to said longitudinal axis, wherein each said outer region includes a step region and an outer locking member, with each said speaker located in one of said outer regions between said step region and said outer locking member.

14. The speaker assembly as claimed in claim 9, wherein said bore is located along said flat portion of said housing.

15. The speaker assembly as claimed in claim 10, wherein each outer region includes a notch.

16. A speaker assembly for connecting an audio source to a microphone of a video recorder, comprising:

a housing having a hollow interior;

a pair of outer regions located in said interior of said housing;

an earphone assembly having a pair of speakers, with one of said speakers located in each of said outer regions;

a bore extending into said housing between said outer regions; and an attachment device for holding the speaker assembly against the video recorder microphone.

17. The speaker assembly as claimed in claim 8, wherein the attachment device includes an attachment strap configured to detachably engage the housing.

18. The speaker assembly as claimed in claim 1, wherein the attachment device includes an attachment strap configured to detachably engage the housing.

* * * * *

UNITED STATES PATENT AND TRADEMARK OFFICE

CERTIFICATE OF CORRECTION

PATENT NO. : 5,815,588

DATED : September 29, 1998

INVENTOR(S) : Vespucci B. Traini, Jr.

It is certified that error appears in the above-identified patent and that said Letters Patent is hereby corrected as shown below:

Claim 6 Column 8 Line 16 "grove" should read --groove--.

Signed and Sealed this

Eighth Day of June, 1999

*Attest:*

*Attesting Officer*

Q. TODD DICKINSON

*Acting Commissioner of Patents and Trademarks*